US011611177B2

(12) United States Patent
Sie et al.

(10) Patent No.: US 11,611,177 B2
(45) Date of Patent: Mar. 21, 2023

(54) USB TYPE-C MALE CONNECTOR

(71) Applicant: Transcend Information, Inc., Taipei (TW)

(72) Inventors: Yuan-Tai Sie, Taichung (TW); Shan-Yen Chang, Kaohsiung (TW)

(73) Assignee: Transcend Information, Inc., Taipei (TW)

( * ) Notice: Subject to any disclaimer, the term of this patent is extended or adjusted under 35 U.S.C. 154(b) by 0 days.

(21) Appl. No.: 17/327,778

(22) Filed: May 24, 2021

(65) Prior Publication Data

US 2022/0376442 A1 Nov. 24, 2022

(51) Int. Cl.

*H01R 13/6471* (2011.01)
*H01R 12/70* (2011.01)
*H01R 24/60* (2011.01)

(52) U.S. Cl.

CPC ..... *H01R 13/6471* (2013.01); *H01R 12/70* (2013.01); *H01R 12/707* (2013.01); *H01R 24/60* (2013.01)

(58) Field of Classification Search

CPC .. H01R 12/70; H01R 12/707; H01R 13/6471; H01R 13/6588; H01R 13/6474; H01R 13/6476; H01R 24/60

See application file for complete search history.

(56) References Cited

U.S. PATENT DOCUMENTS

| | | | | |
|---|---|---|---|---|
| 10,038,285 | B2 | 7/2018 | Harashima | |
| 10,103,492 | B2 * | 10/2018 | Ju | H01R 13/631 |
| 10,320,126 | B2 * | 6/2019 | Ju | H01R 13/6583 |
| 10,333,257 | B2 | 6/2019 | Tseng | |
| 11,063,385 | B2 * | 7/2021 | Gu | H01R 13/405 |
| 11,336,057 | B2 * | 5/2022 | Kawasaki | H01R 13/6471 |
| 2017/0025772 | A1 * | 1/2017 | Yu | H01R 13/6471 |
| 2017/0040721 | A1 * | 2/2017 | Tsai | H01R 13/502 |
| 2017/0194755 | A1 * | 7/2017 | Cheng | H01R 12/724 |
| 2017/0352968 | A1 * | 12/2017 | Zhang | H01R 13/6594 |
| 2017/0352973 | A1 * | 12/2017 | Zhang | H01R 13/6474 |
| 2017/0373439 | A1 * | 12/2017 | Wen | H01R 13/405 |
| 2018/0076581 | A1 * | 3/2018 | Tsai | H01R 13/6585 |
| 2019/0013627 | A1 * | 1/2019 | Zhao | H01R 13/6594 |
| 2020/0091659 | A1 * | 3/2020 | Tada | H01R 13/6461 |
| 2020/0136315 | A1 * | 4/2020 | Tanaka | H01R 13/6585 |
| 2020/0381871 | A1 * | 12/2020 | Oosaka | H01R 24/60 |
| 2021/0203104 | A1 * | 7/2021 | Chen | H01R 13/405 |
| 2021/0320465 | A1 * | 10/2021 | Tada | H01R 24/60 |

* cited by examiner

*Primary Examiner* — Marcus E Harcum
(74) *Attorney, Agent, or Firm* — Winston Hsu

(57) ABSTRACT

A USB Type-C male connector includes a first terminal assembly including a plurality of first pins and a second terminal assembly including a plurality of second pins. The first pins of the first terminal assembly having an SMD structure are electrically connected to a substrate in the SMT process. The second pins of the second terminal assembly having a DIP structure are electrically connected to the substrate in the SMT process. More pins of the second terminal assembly are used for transmitting data signals, control signals and power signals, thereby improving the signal quality of the USB drive.

14 Claims, 13 Drawing Sheets

USB TYPE-C MALE CONNECTOR

BACKGROUND

1. Technical Field

The present invention is related to a USB Type-C male connector, a more particularly, to a USB Type-C male connector which adopts SMD and DIP technologies for improving signal quality.

2. Description of the Conventional Art

Electronic devices are often equipped with various types of interfaces, which enable power and/or data delivery between devices. One example of such interface is the Universal Serial Bus (USB) interface. USB is an industry standard developed by the USB Implementers Forum (USB IF), which defines characteristics of the cables, connectors and communications protocols used in a bus for connection, communication, and power delivery between computers and electronic devices. USB is currently used in various types of devices (such as desktops, laptops, tablets, mobile phones or PDAs) and accessories (such as keyboards, mice, power supplies and chargers, spare battery packs, docking stations, external hard drives, auxiliary storage devices, audio headsets, speakers, or cameras).

In order to enhance the transmission speed, transmission signal type, convenience for plug and unplug, the industry further introduces "Type-C connector". In contrast to the A and B models in the USB family, the "up-down symmetrical structure" of a Type-C connector provides a reversible connector orientation and cable direction. This new ease of attachment eliminates a major pain point of previous connectors and makes it easier to connect. However, in order to allow the plug to be inserted without the need of flipping the up side or bottom side around, the Type-C connector must be provided with two identical sets of connection terminals. In addition, in order to prevent interference between signals of two sets of terminals, a ground piece must be provided within the connector thus to separate these two sets of terminals.

As the current industrial trend focuses on the mainstream design of electronic devices that are light weighted, slim and small in size, such USB Type-C connector poses difficulty and new challenges for the production and assembly process. Especially, when the structure becomes smaller, the distance between terminals undoubtedly is shortened, resulting in the degradation of the shielding effect of the aforementioned ground piece. Therefore, there is a need for a USB Type-C connector which can be manufactured with high reliability and provide stable signal transmission.

SUMMARY

The present invention provides a USB Type-C male connector which includes an insulating base body, a first terminal assembly including a plurality of first pins and a second terminal assembly including a plurality of second pins. Each first pin is provided on the insulating base body within a first range and includes a front end on a first contact region range of the insulating base body in order to be electrically connected to a first signal terminal of a USB Type-C female connector, and a rear end extending outside the insulating base body in order to be soldered to a corresponding pad of a substrate. Each second pin is provided on the insulating base body within a second range corresponding to the first range and includes a front end exposed on a second contact region of the insulating base body in order to be electrically connected to a second signal terminal of the USB Type-C female connector, and a rear end extending outside the insulating base body and bending towards the substrate in order to be inserted into and soldered to a corresponding through-hole pad of the substrate. The number of the plurality of first pins transmitting one or multiple first signals is equal to 2 or 3. The one or multiple first signals is selected from a first differential data signal, a second differential data signal, a third differential data signal, a fourth differential data signal, a fifth differential data signal, a sixth differential data signal, a configuration channel signal (CC), a sideband use signal (SBU) and a voltage connect signal (VCONN) without repetition. The plurality of first pins which do not transmit the one or multiple first signals include a power pin, a ground pin or a floating pin. The number of the plurality of second pins transmitting one or multiple second signals is more than or equal to 5. The one or multiple second signals is selected from the first differential data signal, the second data differential signal, the third differential data signal, the fourth differential data signal, the fifth differential data signal, the sixth differential data signal, the configuration channel signal, the sideband use signal and the voltage connect signal without repetition. The plurality of second pins which do not transmit the one or multiple second signals include a power pin, a ground pin or a floating pin. The sum of the number of the plurality of first pins transmitting one or multiple first signals and the number of the plurality of second pins transmitting one or multiple second signals is smaller than or equal to 12. Each data differential signal selected by the one or multiple first signals is different from each data differential signal selected by the one or multiple second signals.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
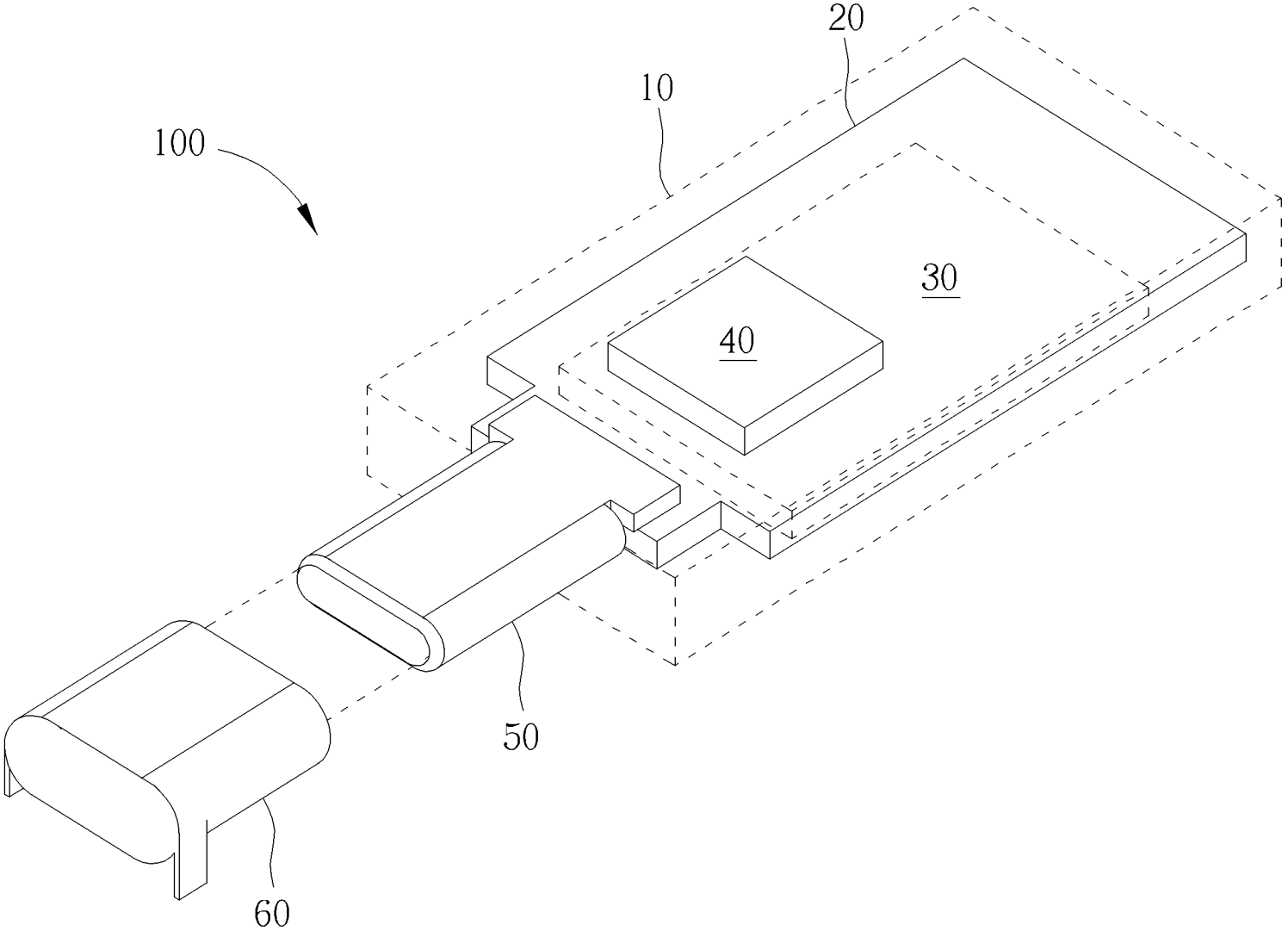
FIG. 1 is a perspective view illustrating a USB drive according to an embodiment of the present invention.

FIG. 1 is a perspective view illustrating a USB drive 100 according to an embodiment of the present invention. The USB drive 100 is an example of an electronic device and may be referred to as, for example, a semiconductor memory device, a semiconductor device, a storage device, an auxiliary storage device, or a removable medium. The electronic device may be, for example, a portable computer, a tablet, a television receiver, a display, a smart phone, a mobile phone, an IC recorder, consumer electronics, an auxiliary storage device such as a hard disk drive (HDD) or a solid state drive (SSD), a cable or an adapter for connecting a device with another device, or any other electronic device. The USB drive 100 may be formed in a rectangular parallelepiped shape as depicted in FIG. 1, or in any other shape. However, the type or the shape of the USB drive 100 does not limit the scope of the present invention.

The USB drive 100 includes a casing 10, a substrate 20, a semiconductor memory 30, a controller 40, and a plug 50. The casing 10 accommodates the substrate 20, the semiconductor memory 30, the controller 40, and a part of the plug 50. The plug 50 is an example of a USB Type-C male connector and can be inserted into a socket 60. The socket 60 is an example of a USB Type-C female connector, and may be mounted in a host device such as a portable computer, a tablet, a television receiver, a display, a smart phone, a mobile phone, or any consumer electronics. The USB drive 100 can communicate with the host device through the plug 50 and the socket 60. The socket 60 may be mounted in other electronic devices such as a cable or an adapter for connecting a device with another device.

In the present invention, the semiconductor memory 30 may be a non-volatile memory which includes, but not limited to, a flash semiconductor memory, a NAND semiconductor memory, a NOR semiconductor memory, a magnetoresistive random access memory (MRAM), a phase change random access memory (PRAM), a resistive random access memory (ReRAM), or a ferroelectric random access memory (FeRAM). However, the type of the semiconductor memory 30 does not limit the scope of the present invention.

In the present invention, the controller 40 is configured to manage data stored in the semiconductor memory 30 and communicate with a computer or an electronic device. In the embodiment depicted in FIG. 1, the controller 40 is electrically connected to the substrate 20 and the semiconductor memory 30, for example, through a plurality of electrodes and wirings (not shown in FIG. 1). However, the implementation of the controller 40 does not limit the scope of the present invention.

Figure 2:
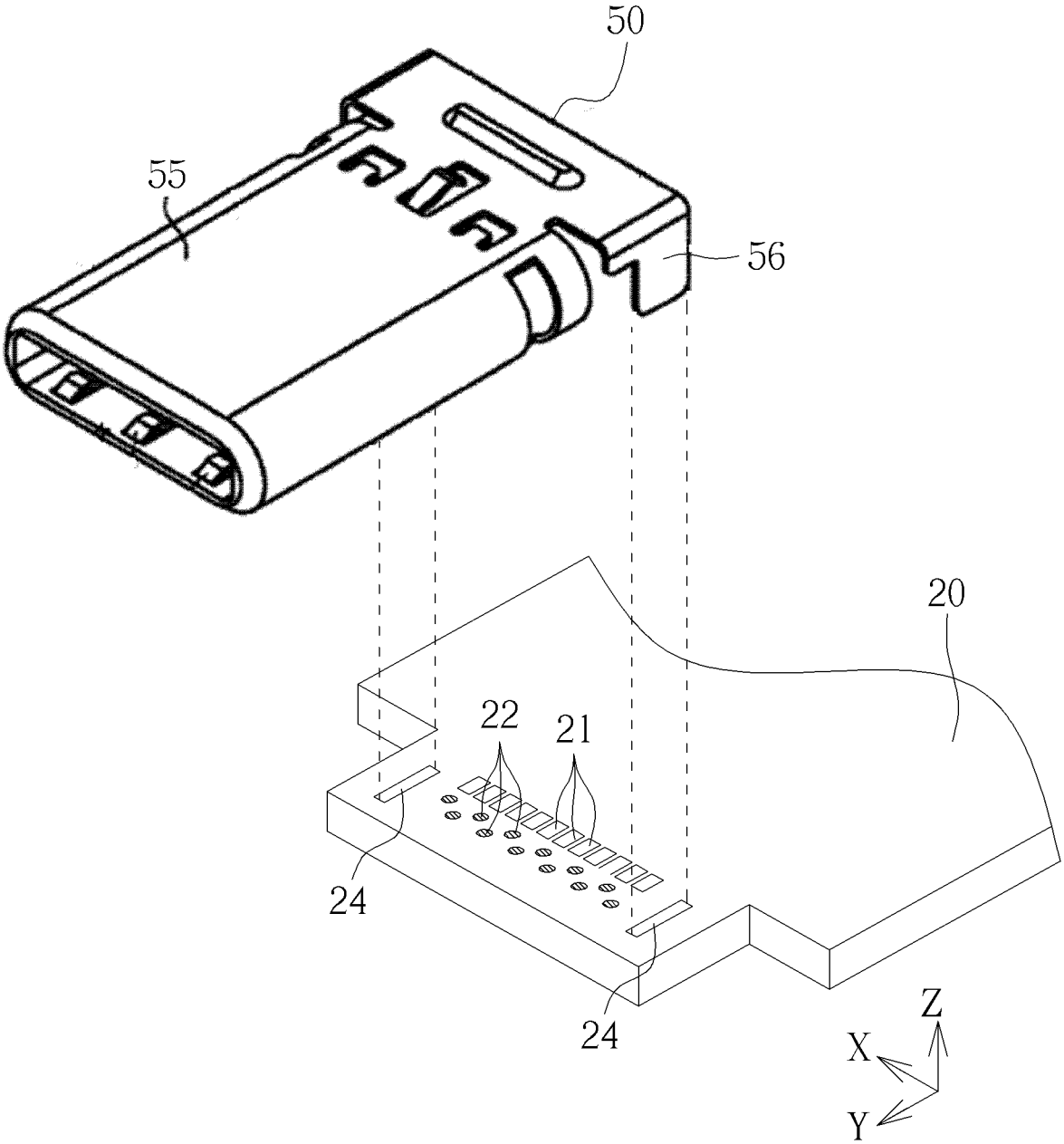
FIG. 2 is a diagram illustrating a part of the substrate and a USB Type-C male connector according to an embodiment of the present invention.
Figure 3:
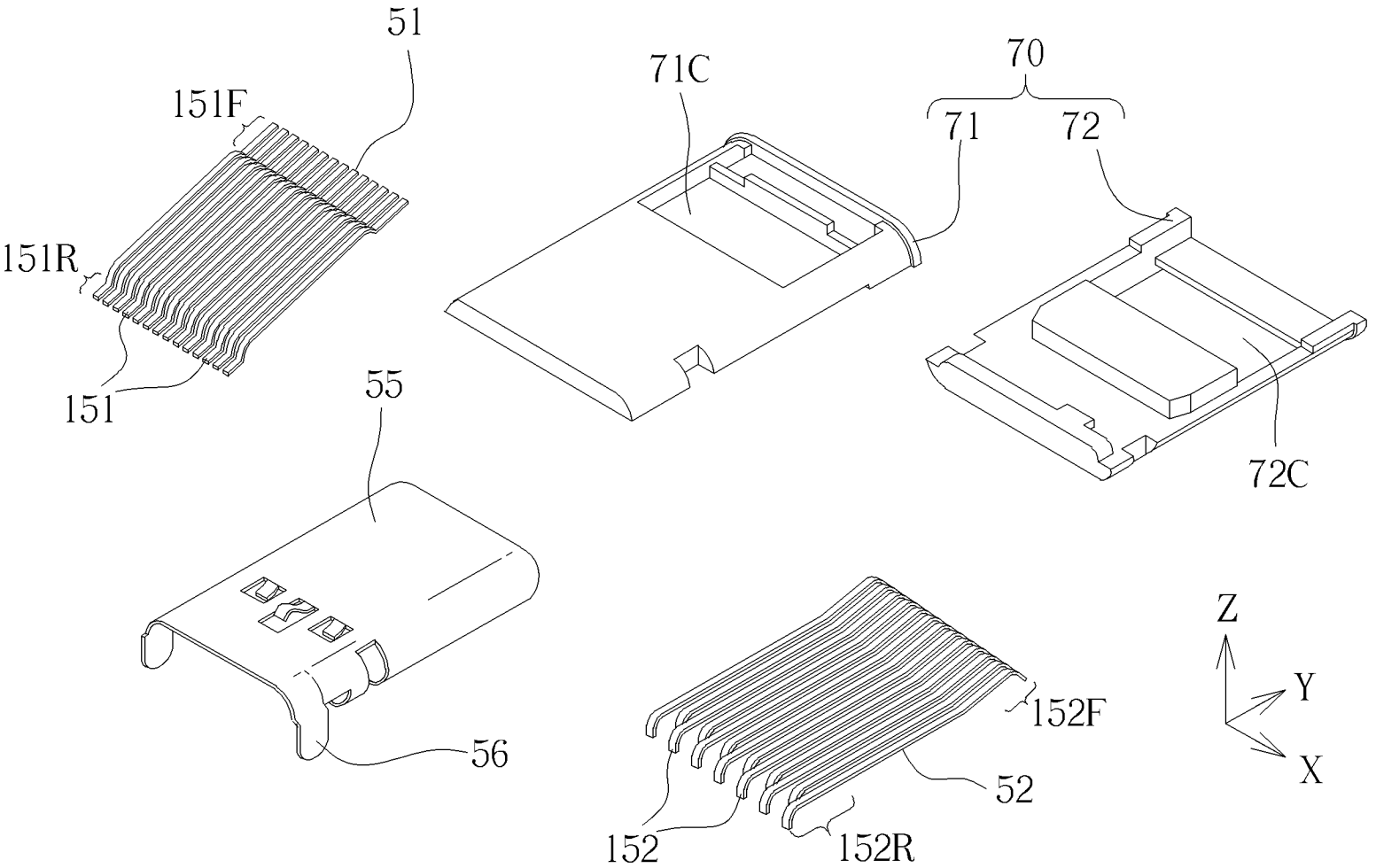
FIG. 3 is an explosion diagram of a USB Type-C male connector according to an embodiment of the present invention.
Figure 4:
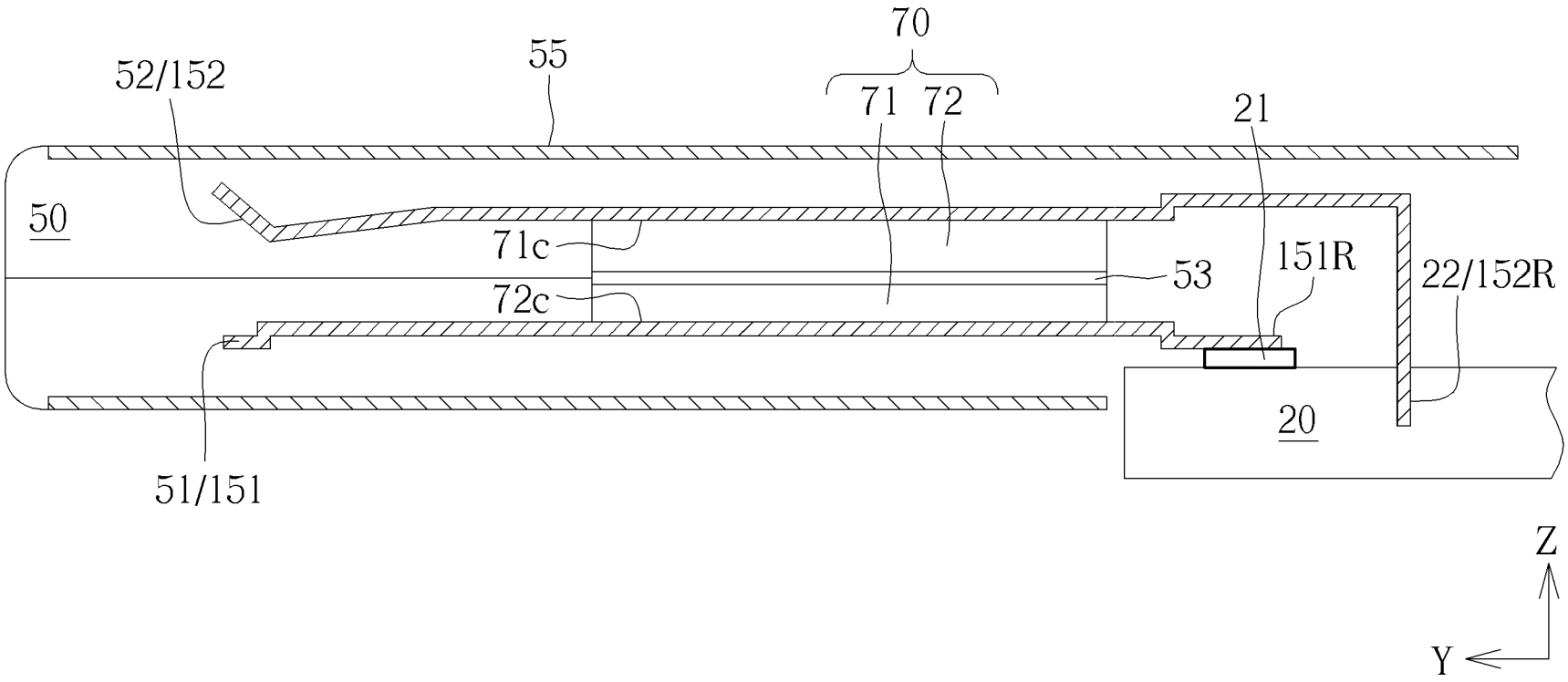
FIG. 4 is a cross-sectional diagram illustrating a part of a USB Type-C male connector according to an embodiment of the present invention.
Figure 5:
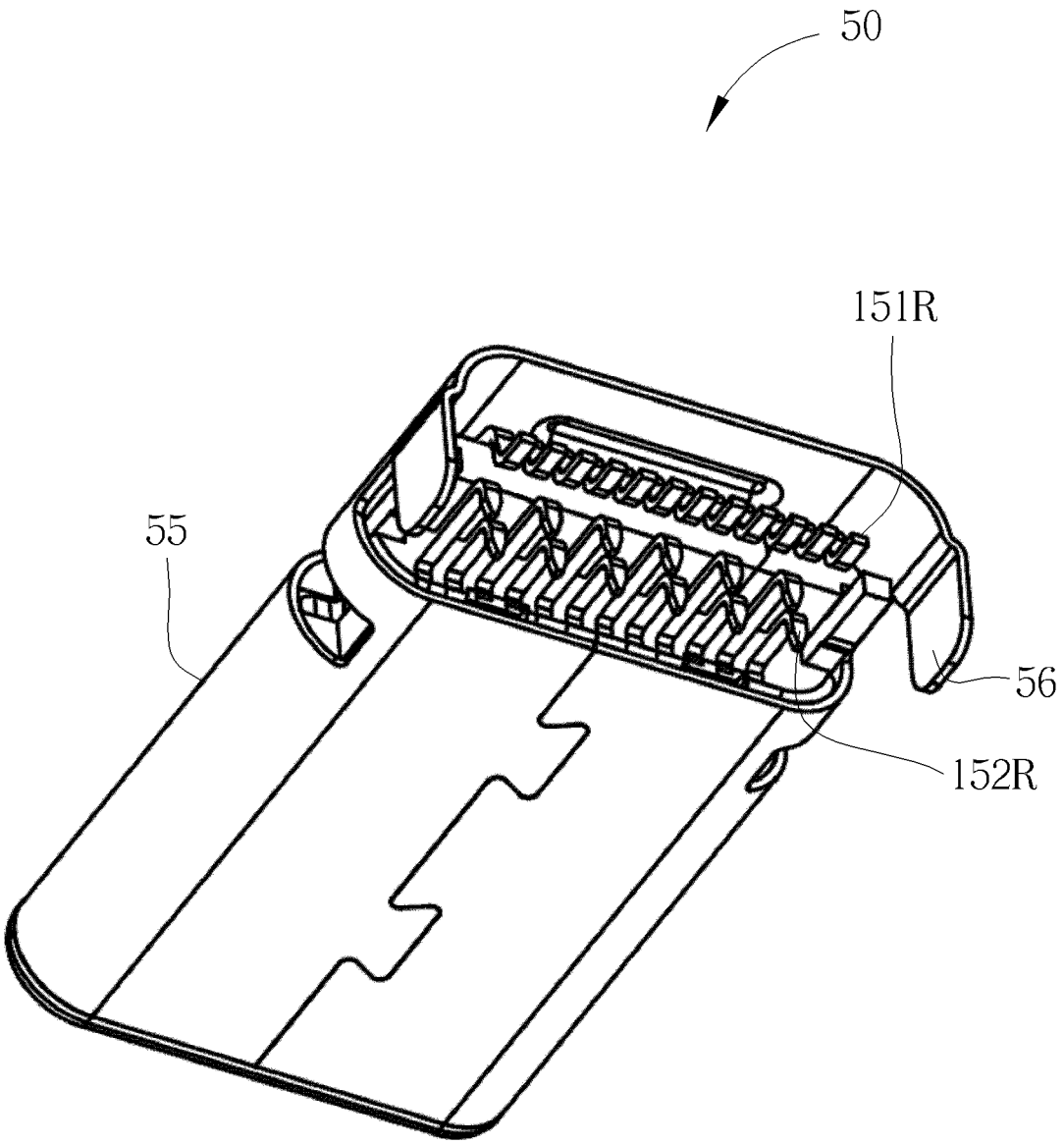
FIG. 5 is a diagram illustrating the back view of a USB Type-C male connector according to an embodiment of the present invention.

FIG. 2 is a diagram illustrating a part of the substrate 20 and the plug (a USB Type-C male connector) 50 according to an embodiment of the present invention. FIG. 3 is an explosion diagram of the plug (a USB Type-C male connector) according to an embodiment of the present invention. FIG. 4 is a cross-sectional diagram illustrating a part of the substrate 20 and the plug (a USB Type-C male connector) 50 according to an embodiment of the present invention. FIG. 5 is a perspective diagram illustrating the back view of the plug (a USB Type-C male connector) 50 according to an embodiment of the present invention. As illustrated in the drawings, in this specification, an X-axis, a Y-axis, and a Z-axis are defined. The X-axis, the Y-axis, and the Z-axis are orthogonal to one another. The X-axis runs along the width of the plug 50. The Y-axis runs along the length of the plug 50. The Z-axis runs along the thickness of the plug 50.

As depicted in FIG. 2, a plurality of pads 21, a plurality of through-hole pads 22, and holes 24 may be provided on a surface of the substrate 20. The substrate 20 may be a printed circuit board (PCB), a flexible printed circuit board (FPC) or any other circuit board. The substrate 20 may be formed in a substantially quadrilateral (rectangular) shape or in any other shape. However, the type or the shape of the substrate 20 does not limit the scope of the present invention.

As depicted in FIGS. 2-5, the plug (USB Type-C male connector) 50 includes a first terminal assembly 51, a second terminal assembly 52, a metal housing 55, and one or multiple attaching portions 56, and an insulating base body 70. The metal housing 55 accommodates at least a part of the first terminal assembly 51, at least a part of the second terminal assembly 52, and the insulating base body 70. Each attaching portion 56 of the plug 50 may be fixed to a corresponding hole 24 in the substrate 20, for example, by soldering. The first terminal assembly 51 may thus be electrically connected to corresponding pads 21 of the substrate 20 using a surface mount technology (SMT). The second terminal assembly 52 of the plug 50 may thus be electrically connected to corresponding through-hole pads 22 of the substrate 20 using SMT.

As depicted in FIGS. 3 and 4, the insulating base body 70 can be one component or consist of a first part 71 and a second part 72. The first part 71 of the insulating base body 70 includes a contact region 71C. The second part 72 of the insulating base body 54 includes a contact region 72C.

As depicted in FIGS. 3 and 4, the first terminal assembly 51 is a surface-mounted device (SMD) which includes a plurality of first pins 151 provided on the first part 71 of the insulating base body 70. The front end 151F of each first pin 151 is exposed on the contact region 71C of the first part 71 of the insulating base body 70 (in the direction along the Y-axis) in order to be electrically connected to a first signal terminal of a USB Type-C female connector (not shown in FIGS. 2-4). The rear end 151R of each first pin 151 extends outside the insulating base body 70 (in the negative direction along the Y-axis) in order to be soldered to a corresponding pad 21 of the substrate 20 in an SMT process. The second terminal assembly 52 is a dual in-line package (DIP) device which includes a plurality of second pins 152 provided on the second part 72 of the insulating base body 70. The front end 152F of each second pin 152 is exposed on the contact region 72C of the second part 72 of the insulating base body 70 (in the direction along the Y-axis) in order to be electrically connected to a second signal terminal of a USB Type-C female connector (not shown in FIGS. 2-4). The rear end 152R of each second pin 152 bends towards the substrate 20 (in the negative direction along the Z-axis) in order to be inserted into and soldered to a corresponding through-hole pad 22 of the substrate 20 in an SMT process.

SMT is the most popular technology and process in the electronic assembly industry. In the SMT process, surface-mounted components are installed on the surface of a circuit board or other substrate, and soldered and assembled by reflow soldering or immersion soldering, while through-hole components are plugged into holes of a circuit board or other substrate. SMD devices are advantageous over DIP devices in smaller components, higher component density, automatic corrections of small errors in component placement, better mechanical performance under shock and vibration conditions, and lower resistance and inductance at the connection, and simpler/faster/cheaper automated assembly. However, solder joint dimensions in SMD quickly become much smaller as advances are made toward ultra-fine pitch technology. The reliability of solder joints becomes more of a concern, and may impact signal quality. On the other hand, DIP devices are advantageous over SMD devices in easy insertion by hand or machine, and providing high reliability.

Figure 6A:
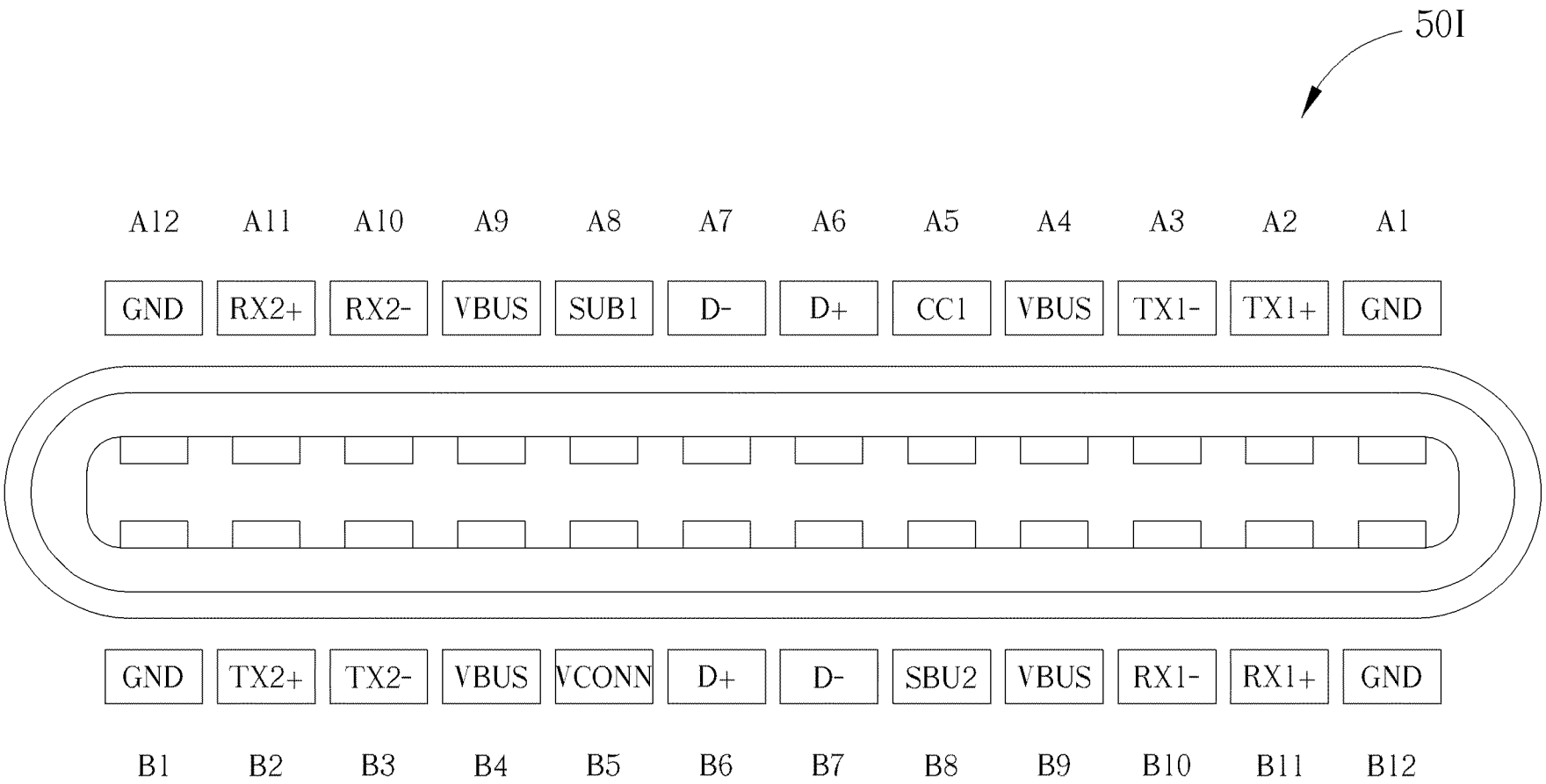
FIG. 6A is a diagram illustrating a USB Type-C male interface definition according to the USB-IF specification standard.
Figure 6B:
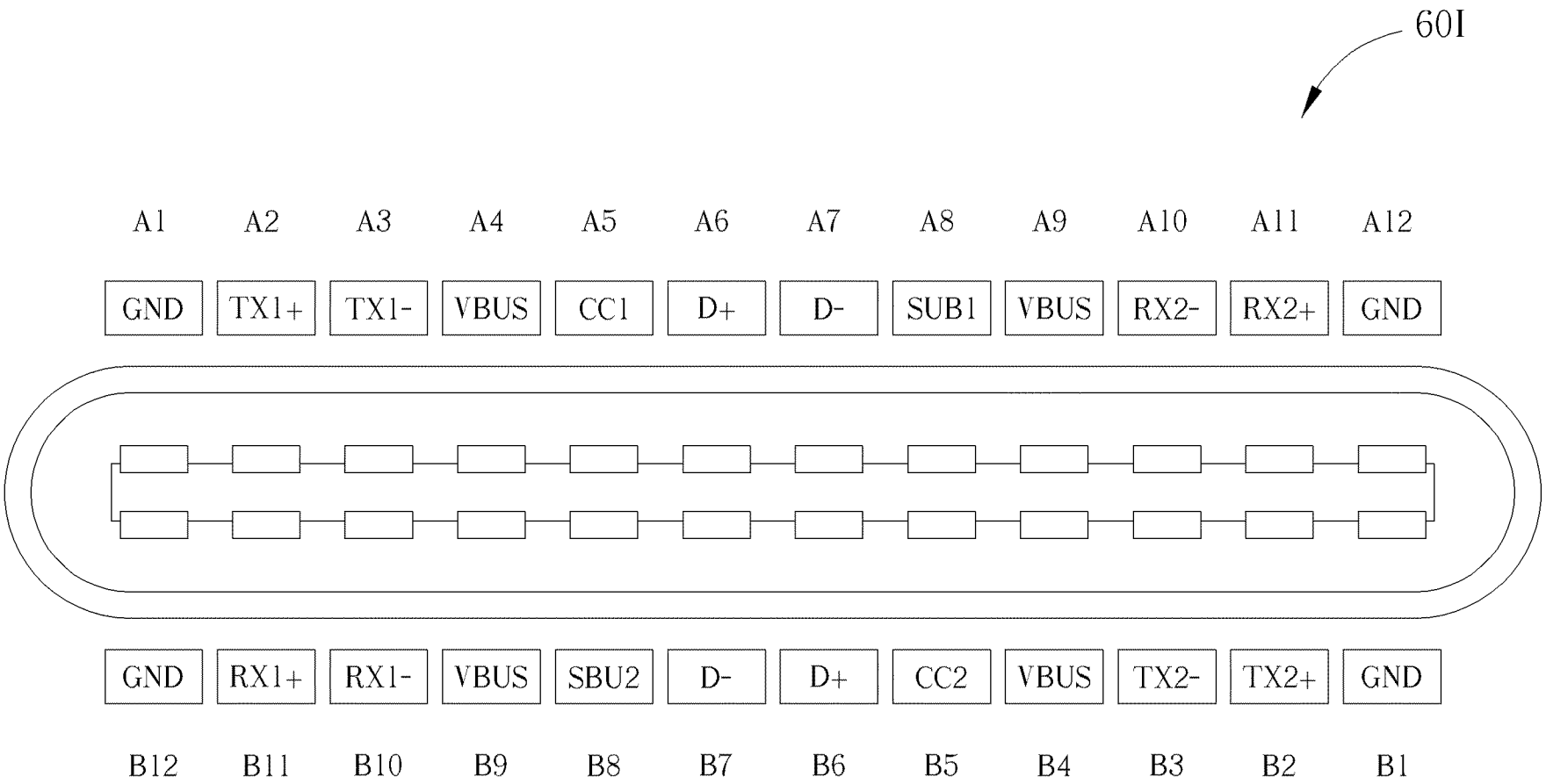
FIG. 6B is a diagram illustrating a USB Type-C female connector interface definition according to the USB-IF specification standard.

In the present invention, the plug (male connector) 50 and the socket (female connector) 60 are USB connectors complying with a USB Type-C standard from USB-IF (USB Implementers Forum, Inc.) specification. FIG. 6A is a diagram illustrating a USB Type-C male connector (plug) interface 50I definition according to the USB-IF specification standard. FIG. 6B is a diagram illustrating a USB Type-C female connector (socket) interface 60I definition according to the USB-IF specification standard. The USB Type-C male connector interface 50I includes two pairs of ground pins GND (at A1/A12 and B1/B12 locations), four pairs of high speed differential data bus pins TX1+/TX1−, TX2+/TX2−, RX1+/RX1−, and RX2+/RX2−(at A2/A3, B2/B3, B11/B10, and A11/A10 locations), four voltage pins VBUS (at A4/A9 and B4/B9 locations), one configuration channel pin CC1 (at A5 location), one voltage connect pin VCONN (at B5 location), two pairs of differential data bus pins D+ and D− (at A6/A7 and B6/B7 locations), and two sideband use pins SBU1 and SBU2 (at A8 and B8 locations). The USB Type-C female connector interface 60I includes two pairs of ground pins GND (at A1/A12 and B1/B12 locations), four pairs of high speed differential data bus pins TX1+/TX1−, TX2+/TX2−, RX1+/RX1−, and RX2+/RX2− (at A2/A3, B2/B3, B11/B10, and A11/A10 locations), four power pins VBUS (at A4/A9 and B4/B9 locations), two configuration channel pins CC1 and CC2 (at A5 and B5 locations), two pairs of differential data bus pins D+ and D− (at A6/A7 and B6/B7 locations), and two sideband use pins SBU1 and SBU2 (at A8 and B8 locations). With references to FIGS. 3, 4, 6A and 6B, the first terminal assembly 51 includes the pins of the USB Type−C male connector interface 50I at A1-A12 locations, and the second terminal assembly 52 includes the pins of the USB Type-C male connector interface 50I at B1-B12 locations.

During the operation of the USB drive 100, the differential data bus pins TX1+/TX1−, TX2+/TX2−, RX1+/RX1−, RX2+/RX2− pins and D+/D− pins are used for transmitting data signals, the configuration channel pin CC1/CC2 and the sideband use pins SBU1/SBU2 are used for transmitting control signals, and the ground pins GND, the power pins VBUS and the voltage connect pin VCONN are used for transmitting power signals.

Unlike the USB Type-C female connector interface 60I, the USB Type-C male connector interface 50I only includes one configuration channel pin, but further includes a voltage connect pin VCONN to provide power to circuits within the USB Type-C male connector (plug 50). When the USB Type-C male connector (plug 50) is inserted into the USB Type-C female connector (socket 60), one of the configuration channel pins (CC1 or CC2) in the USB Type-C female connector interface 60I is connected to the configuration channel pin in the USB Type-C male connector interface 50I through the cable to establish signal orientation. The configuration channel pins are generally used for detecting cable attach and detach, detecting plug orientation (i.e., right side-up or upside-down), and establishing VBUS current. In USB Type-C connectors, the configuration channel pins are also used for transmitting and receiving USB Power Delivery (PD) communication messages in order to establish power contracts and communicate with cables.

In the present invention, only two or three pins of the first terminal assembly 51 are used for transmitting data signals and optionally control signals. The above-mentioned two or three pins of the first terminal assembly 51 may be used for transmitting first signals which are selected from a plurality of differential data signal, a configuration channel signal, a sideband use signal and a voltage connect signal without repetition. Other pins of the first terminal assembly 51 which do not transmit the first signals include a power pin, a ground pin or a floating pin.

In the present invention, five or more pins of the second terminal assembly 52 are used for transmitting data signals and control signals. The above-mentioned five or more pins of the second terminal assembly 52 may be used for transmitting second signals which are selected from a plurality of differential data signal, a configuration channel signal, a sideband use signal and a voltage connect signal without repetition. Other pins of the second terminal assembly 52 which do not transmit the second signals include a power pin, a ground pin or a floating pin.

In the present invention, the sum of the pins of the first terminal assembly 51 and the second terminal assembly 52 used to transmit the first and second signals is smaller than or equal to 12. In other words, among the 24 pins defined by the USB specification as depicted in FIG. 6A, the USB drive 100 of the present invention only use half or fewer of the existing pins for signal transmission. Also, each first signal transmitted by the first terminal assembly 51 is different from each second signal transmitted by the second terminal assembly 52.

FIGS. 7-12 are diagrams illustrating the implementation of signal paths between the plug 50 and the substrate 20 of the USB drive 100 according to embodiments of the present invention. With reference made to FIG. 6A, the pins of the first terminal assembly 51 are designated by A1-A12 locations, and the pins of the second terminal assembly 52 are designated by B1-B12 locations.

Figure 7:
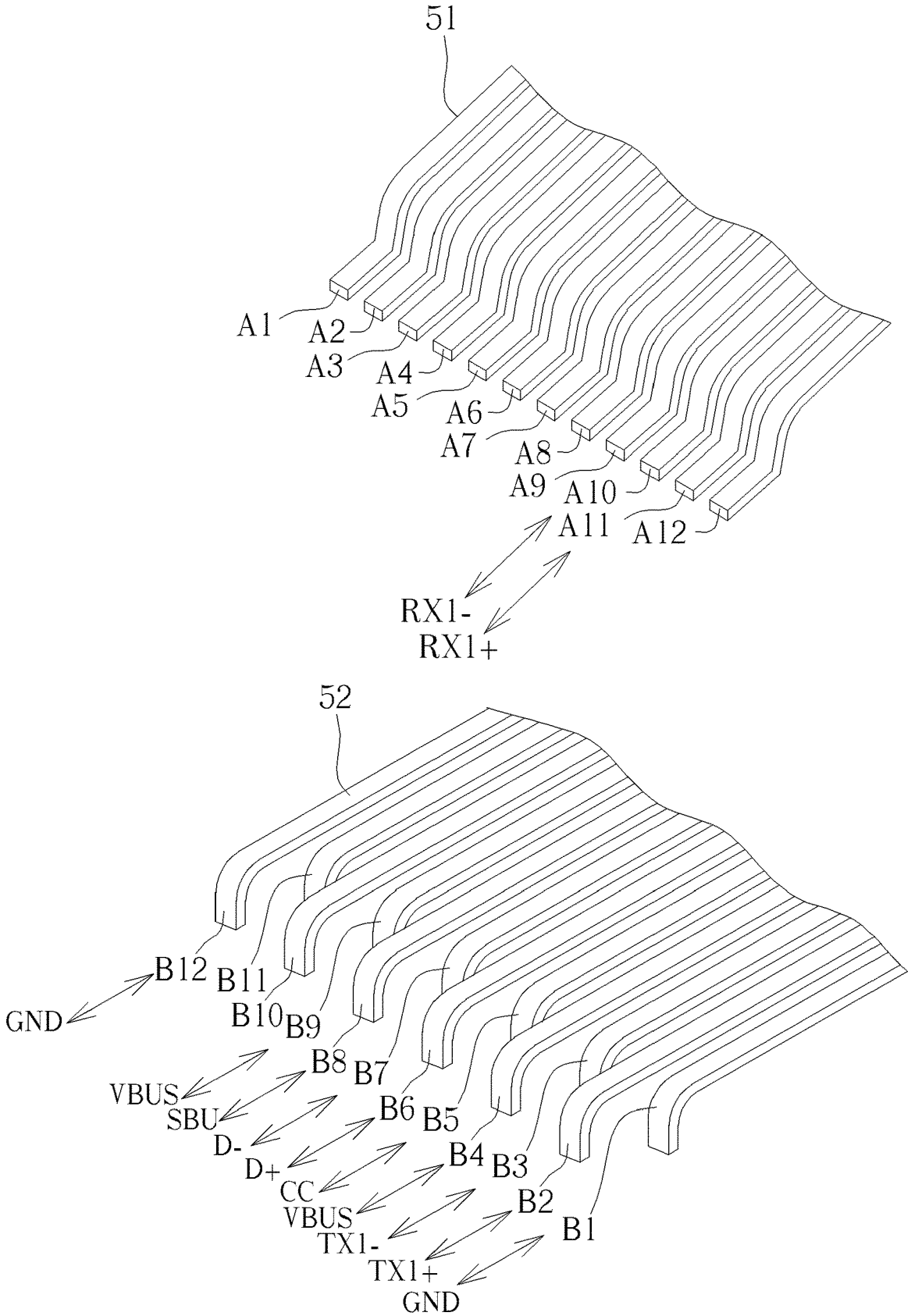
FIG. 7 is a diagram illustrating an implementation of signal paths of a USB Type-C male connector according to an embodiment of the present invention.

As depicted in FIG. 7, among the pins of the first terminal assembly 51 having SMD structure, only the pair of high speed differential data bus pins RX1+/RX1− at A11/A10 locations are coupled to the corresponding pads on the substrate 20 for transmitting data signals. Each of the other pins in the first terminal assembly 51 at A1-A9 and A12 locations may be a power pin, a ground pin or a floating pin since they are not required to transmit data signals. Among the pins of the second terminal assembly 52 having DIP structure, the ground pins GND at B1/B12 locations, the pair of high speed differential data bus pins TX1+/TX1− at B2/B3 locations, the VBUS pins at B4/B9 locations, the configuration channel pin CC at B5 location, the pair of differential data bus pins D+ and D− at B6/B7 locations, and the sideband use pin SBU at B8 location are coupled to the corresponding through-hole pads on the substrate 20 for transmitting data signals, control signals and power signals.

Each of the other pins in the second terminal assembly 52 at B10 and B11 locations may be a power pin, a ground pin or a floating pin since they are not required to transmit data signals.

Figure 8:
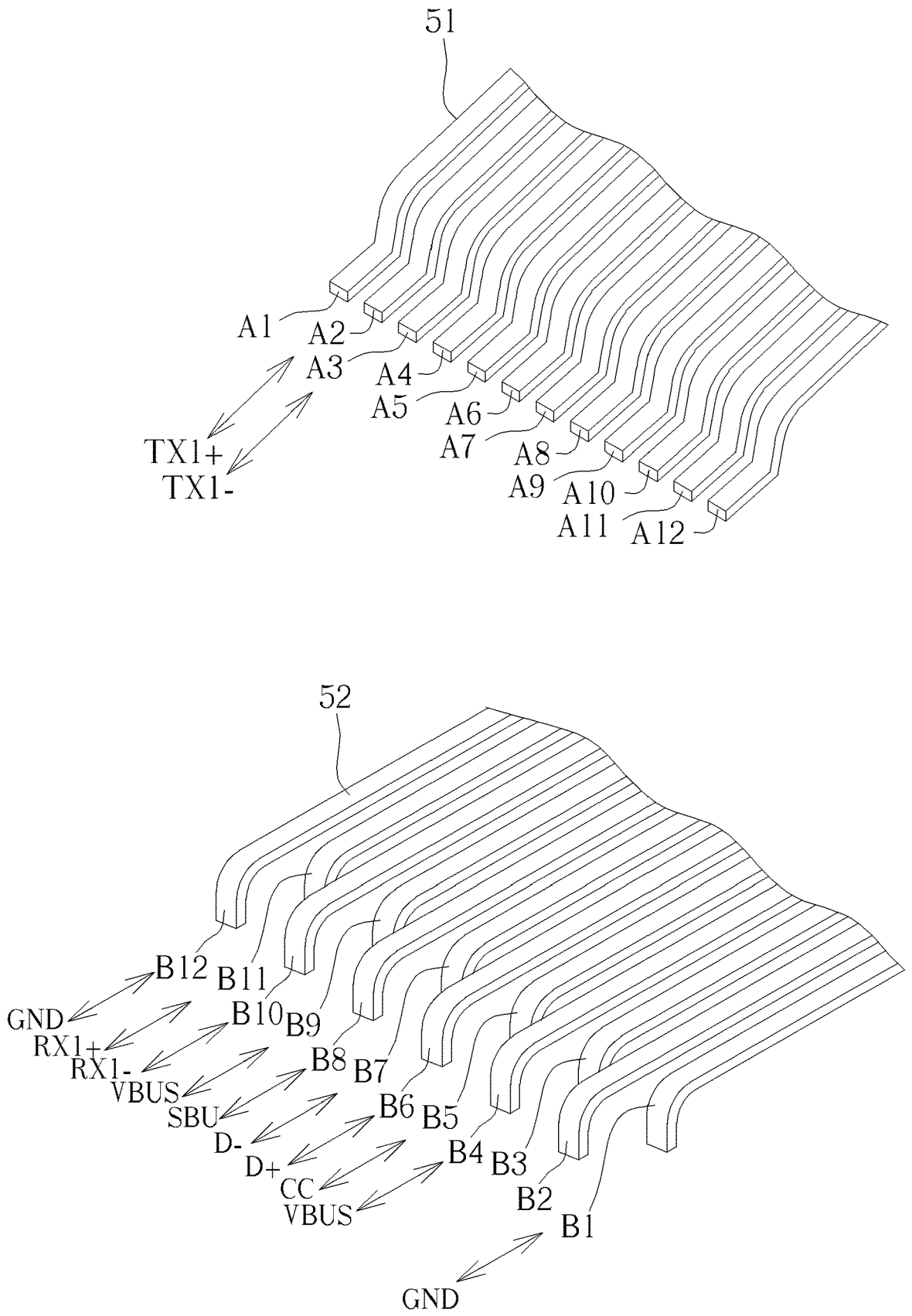
FIG. 8 is a diagram illustrating an implementation of signal paths of a USB Type-C male connector according to another embodiment of the present invention.

As depicted in FIG. 8, among the pins of the first terminal assembly 51 having SMD structure, only the pair of high speed differential data bus pins TX1+/TX1 at A2/A3 locations are coupled to the corresponding pads on the substrate 20 for transmitting data signals. Each of the other pins in the first terminal assembly 51 at A1 and A4-A12 locations may be a power pin, a ground pin or a floating pin since they are not required to transmit data signals. Among the pins of the second terminal assembly 52 having DIP structure, the ground pins GND at B1/B12 locations, the VBUS pins at B4/B9 locations, the configuration channel pin CC at B5 location, the pair of differential data bus pins D+ and D− at B6/B7 locations, the sideband use pin SBU at B8 location, and the pair of high speed differential data bus pins RX1+/RX1− at B11/B10 locations are coupled to the corresponding through-hole pads on the substrate 20 for transmitting data signals, control signals and power signals. Each of the other pins in the second terminal assembly 52 at B2 and B3 locations may be a power pin, a ground pin or a floating pin since they are not required to transmit data signals.

Figure 9:
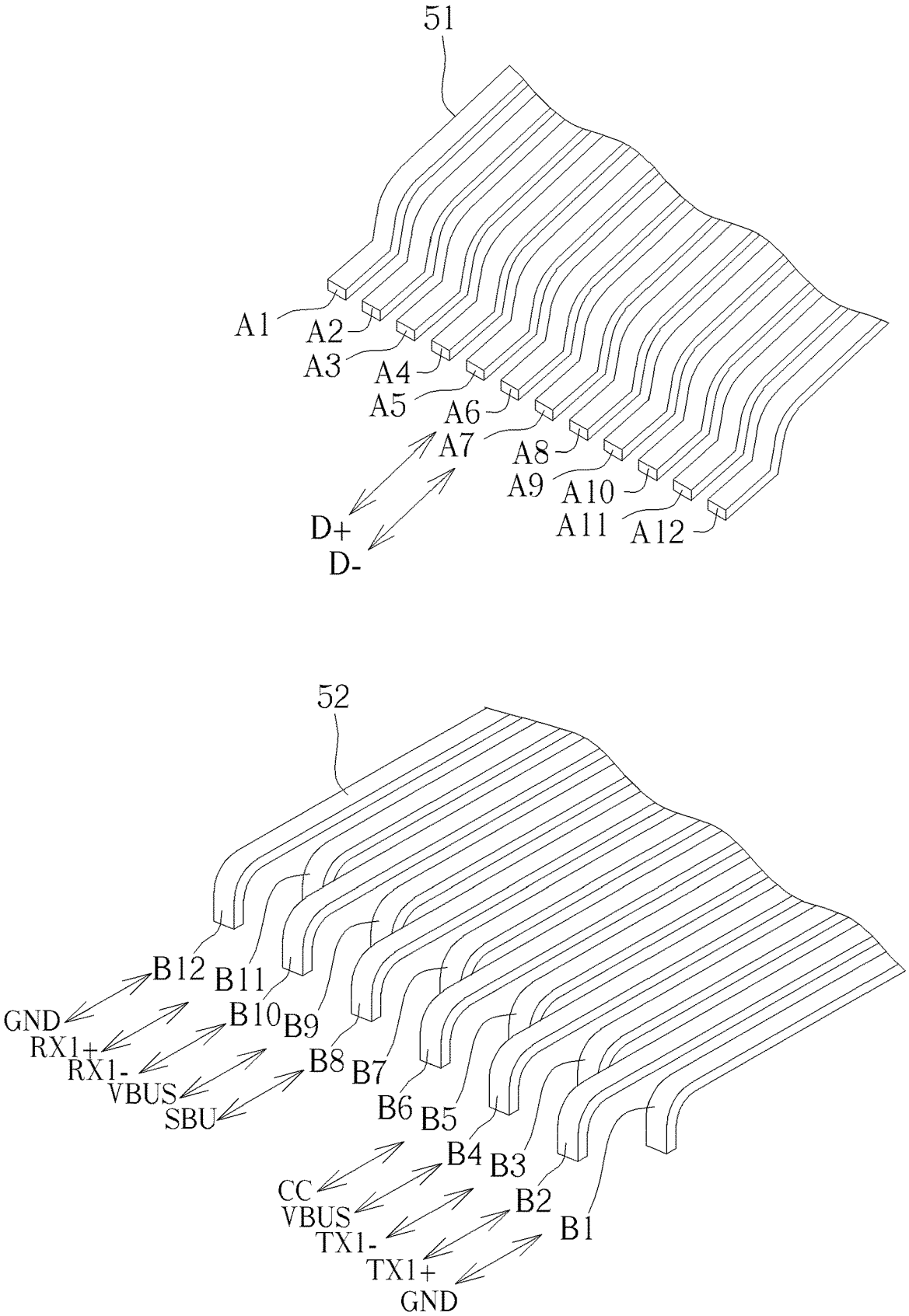
FIG. 9 is a diagram illustrating an implementation of signal paths of a USB Type-C male connector according to another embodiment of the present invention.

As depicted in FIG. 9, among the pins of the first terminal assembly 51 having SMD structure, only the pair of high speed differential data bus pins D+ and D− at A6/A7 locations are coupled to the corresponding pads on the substrate 20 for transmitting data signals. Each of the other pins in the first terminal assembly 51 at A1-A5 and A8-A12 locations may be a power pin, a ground pin or a floating pin since they are not required to transmit data signals. Among the pins of the second terminal assembly 52 having DIP structure, the ground pins GND at B1/B12 locations, the pair of high speed differential data bus pins TX1+/TX1 at B2/B3 locations, the VBUS pins at B4/B9 locations, the configuration channel pin CC at B5 location, the sideband use pin SBU at B8 location, and the pair of high speed differential data bus pins RX1+/RX1− at B11/B10 locations are coupled to the corresponding through-hole pads on the substrate 20 for transmitting data signals, control signals and power signals. Each of the other pins in the second terminal assembly 52 at B6 and B7 locations may be a power pin, a ground pin or a floating pin since they are not required to transmit data signals.

Figure 10:
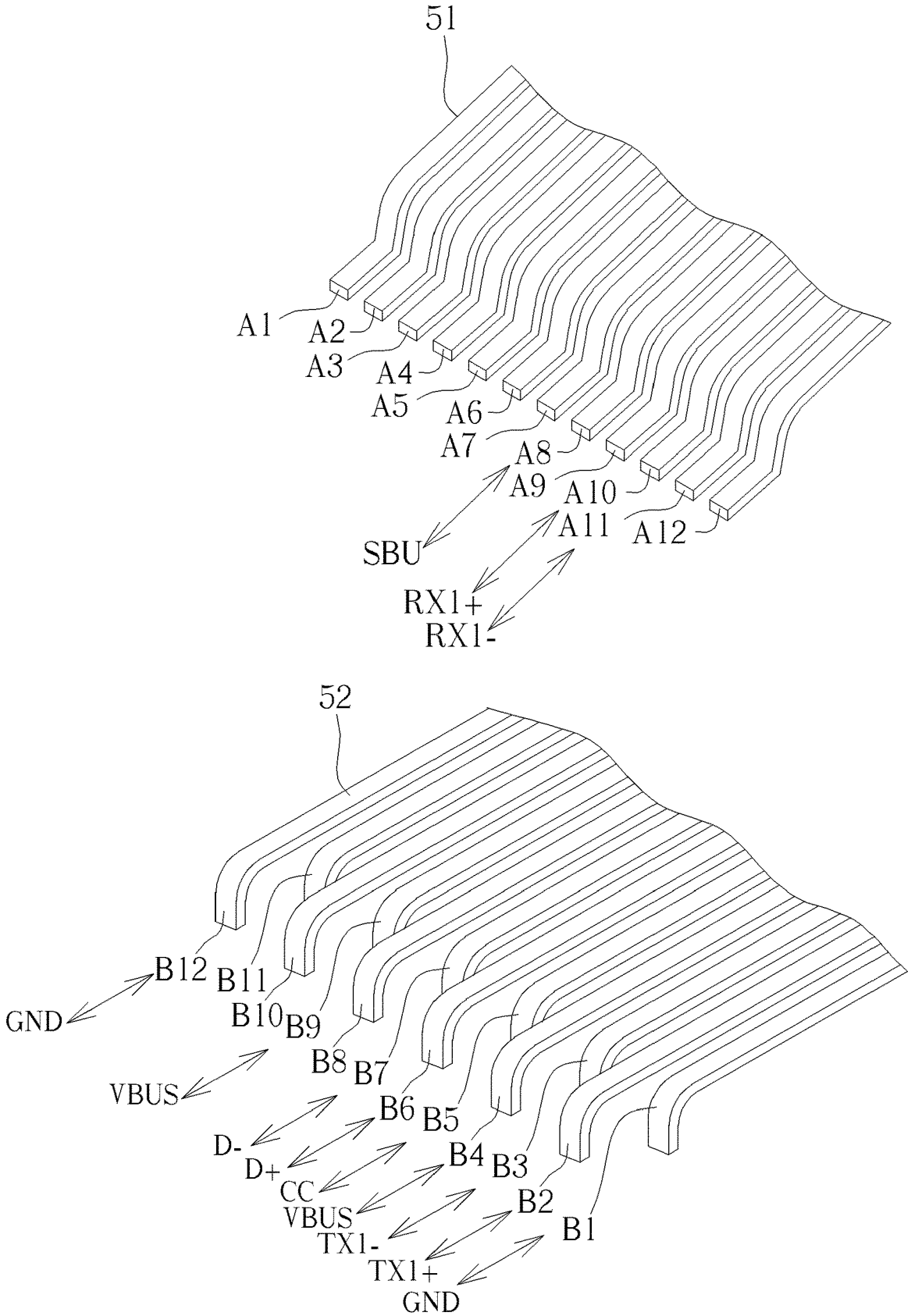
FIG. 10 is a diagram illustrating an implementation of signal paths of a USB Type-C male connector according to another embodiment of the present invention.

As depicted in FIG. 10, among the pins of the first terminal assembly 51 having SMD structure, only the pair of high speed differential data bus pins RX1+/RX1 at A11/A10 locations and the sideband use pin SBU at A8 location are coupled to the corresponding pads on the substrate 20 for transmitting data signals and control signals. Each of the other pins in the first terminal assembly 51 at A1-A7, A9 and A12 locations may be a power pin, a ground pin or a floating pin since they are not required to transmit data signals. Among the pins of the second terminal assembly 52 having DIP structure, the ground pins GND at B1/B12 locations, the pair of high speed differential data bus pins TX1+/TX1− at B2/B3 locations, the VBUS pins at B4/B9 locations, the configuration channel pin CC at B5 location, and the pair of differential data bus pins D+ and D− at B6/B7 locations are coupled to the corresponding pads on the substrate 20 for transmitting data signals, control signals and power signals. Each of the other pins in the second terminal assembly 52 at B8 and B10-B11 locations may be a power pin, a ground pin or a floating pin since they are not required to transmit data signals.

Figure 11:
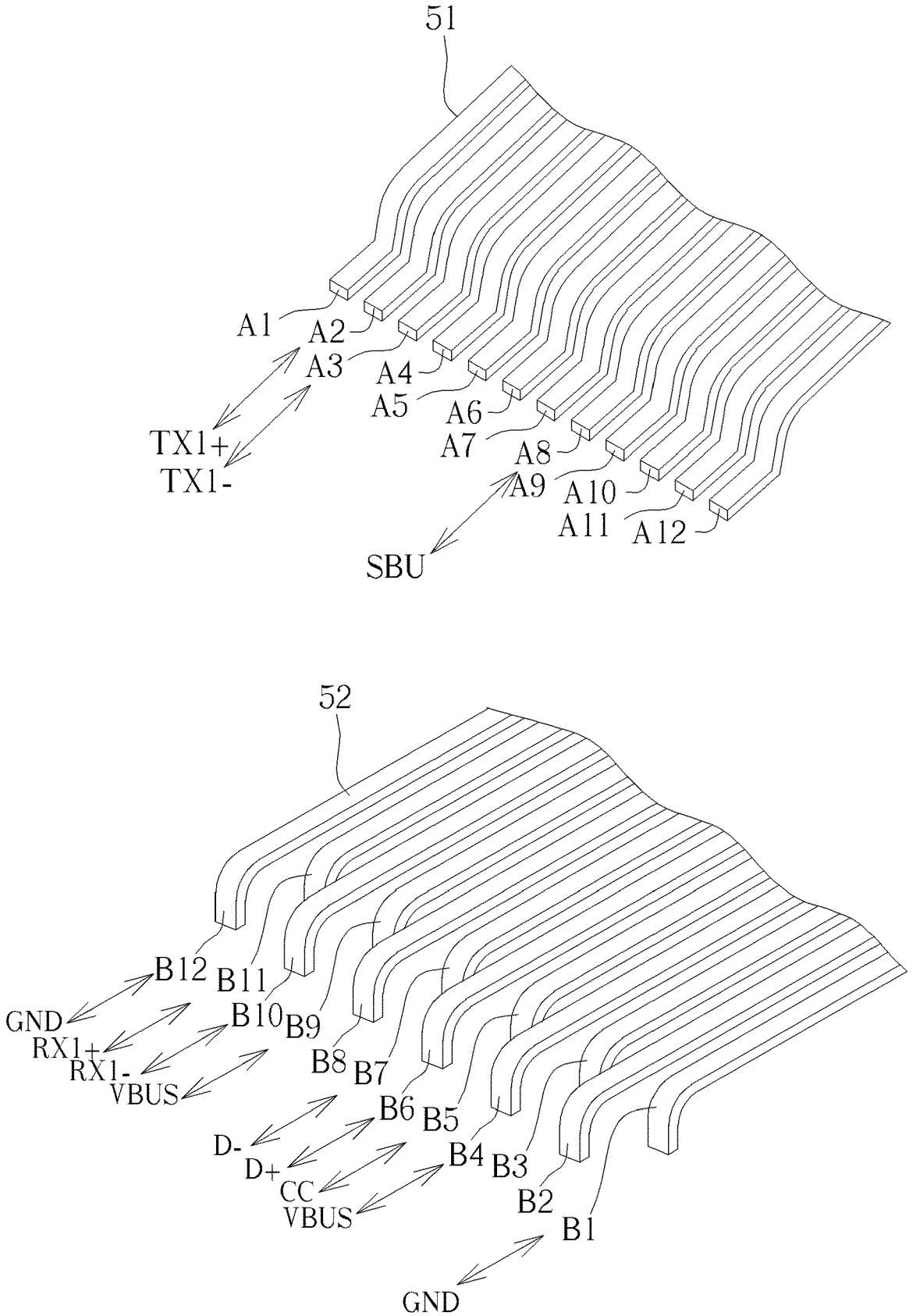
FIG. 11 is a diagram illustrating an implementation of signal paths of a USB Type-C male connector according to another embodiment of the present invention.

As depicted in FIG. 11, among the pins of the first terminal assembly 51 having SMD structure, only the pair of high speed differential data bus pins TX1+/TX1 at A2/A3 locations and the sideband use pin SBU at A8 location are coupled to the corresponding pads on the substrate 20 for transmitting data signals. Each of the other pins in the first terminal assembly 51 at A1, A4-A7 and A9-A12 locations may be a power pin, a ground pin or a floating pin since they are not required to transmit data signals. Among the pins of the second terminal assembly 52 having DIP structure, the ground pins GND at B1/B12 locations, the VBUS pins at B4/B9 locations, the configuration channel pin CC at B5 location, the pair of differential data bus pins D+ and D− at B6/B7 locations, and the pair of high speed differential data bus pins RX1+/RX1− at B11/B10 locations are coupled to the corresponding through-hole pads on the substrate 20 for transmitting data signals, control signals and power signals. Each of the other pins in the second terminal assembly 52 at B2-B3 and B8 locations may be a power pin, a ground pin or a floating pin since they are not required to transmit data signals.

Figure 12:
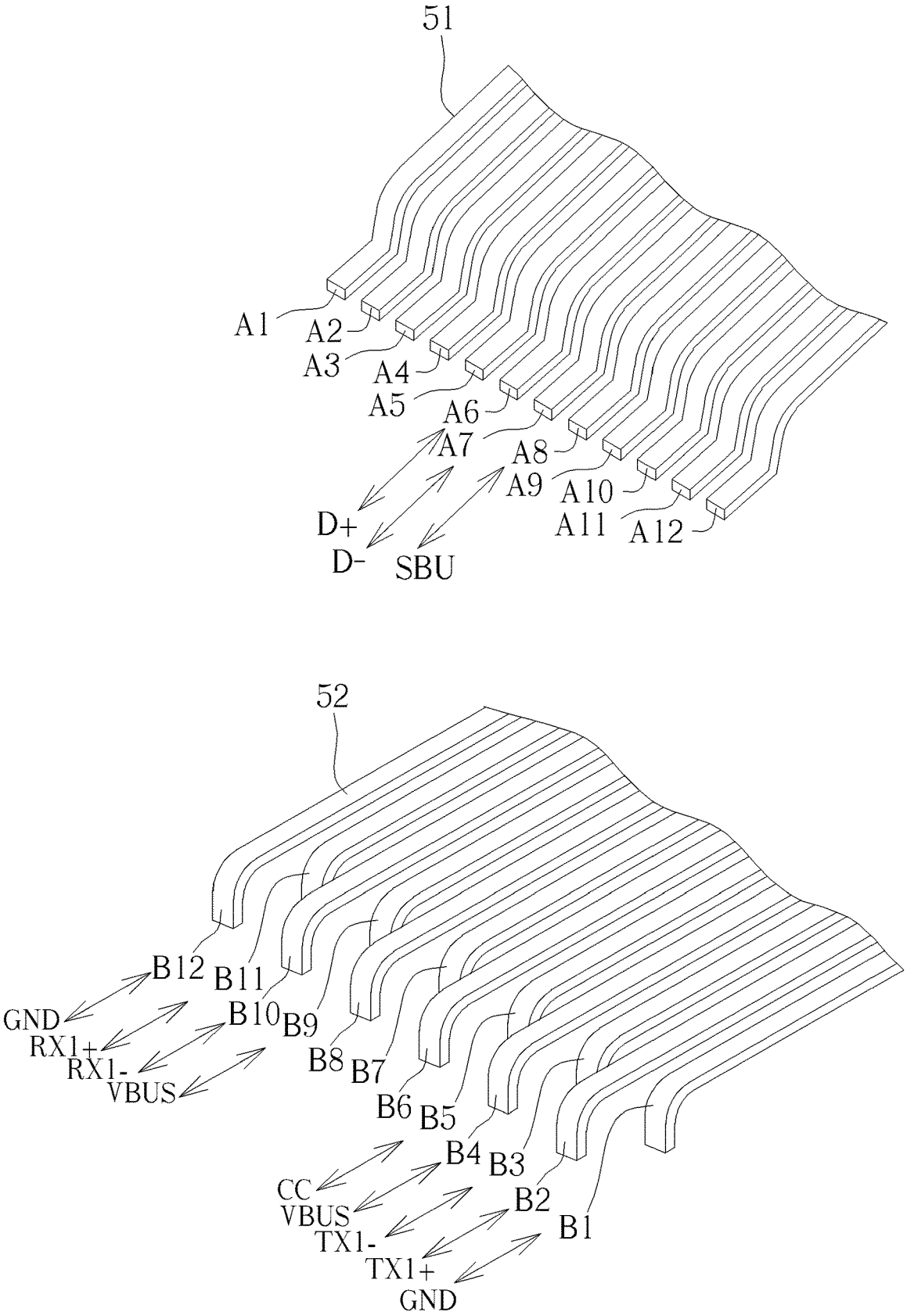
FIG. 12 is a diagram illustrating an implementation of signal paths of a USB Type-C male connector according to another embodiment of the present invention.

As depicted in FIG. 12, among the pins of the first terminal assembly 51 having SMD structure, only the pair of high speed differential data bus pins D+ and D− at A6/A7 locations and the sideband use pin SBU at A8 location are coupled to the corresponding pads on the substrate 20 for transmitting data signals. Each of the other pins in the first terminal assembly 51 at A1-A5 and A9-A12 locations may be a power pin, a ground pin or a floating pin since they are not required to transmit data signals. Among the pins of the second terminal assembly 52 having DIP structure, the ground pins GND at B1/B12 locations, the pair of high speed differential data bus pins TX1+/TX1 at B2/B3 locations, the VBUS pins at B4/B9 locations, the configuration channel pin CC at B5 location, and the pair of high speed differential data bus pins RX1+/RX1− at B11/B10 locations are coupled to the corresponding through-hole pads on the substrate 20 for transmitting data signals, control signals and power signals. Each of the other pins in the second terminal assembly 52 at B6-B8 locations may be a power pin, a ground pin or a floating pin since they are not required to transmit data signals.

In conclusion, in the USB drive 100 of the present invention, the first terminal assembly 51 having SMD structure and the second terminal assembly 52 having DIP structure are electrically connected to the substrate 20 in the SMT process. Due to the high reliability of DIP devices, more pins of the second terminal assembly 52 are used for transmitting data signals, control signals and power signals, thereby improving the signal quality of the USB drive 100.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A Universal Serial Bus (USB) Type-C male connector, comprising:

an insulating base body having a first part and a second part;

a first terminal assembly including 12 pins, wherein each pin is provided on the first part of the insulating base body and includes:

a front end exposed on a first contact region of the first part in order to be electrically connected to a first signal terminal of a USB Type-C female connector; and a rear end extending outside the first part in order to be soldered to a corresponding pad of a substrate; and a second terminal assembly including 12 pins, wherein each pin is provided on the second part of the insulating base body corresponding to the first part and includes:

a front end exposed on a second contact region of the second part in order to be electrically connected to a second signal terminal of the USB Type-C female connector; and a rear end extending outside the second part and bending towards the substrate in order to be inserted into and soldered to a corresponding through-hole pad of the substrate, wherein:

a number of the 12 pins transmitting differential data signals in the first terminal assembly is equal to 2;

the differential data signals transmitted by the 2 pins in the first terminal assembly are selected from a first differential data signal, a second differential data signal, a third differential data signal, a fourth differential data signal, a fifth differential data signal, and a sixth differential data signal without repetition;

other than the 2 pins transmitting the differential data signals in the first terminal assembly, each of remaining 10 pins among the 12 pins of the first terminal assembly is a power pin, a ground pin or a floating pin;

a number of the 12 pins transmitting the differential data signals in the second terminal assembly is equal to 4;

a number of the 12 pins transmitting a configuration channel (CC) signal in the second terminal assembly is equal to 1;

a number of the 12 pins transmitting a sideband use (SBU) signal in the second terminal assembly is equal to 1;

the differential data signals transmitted by the 4 pins in the second terminal assembly are selected from the first differential data signal, the second data differential signal, the third differential data signal, the fourth differential data signal, the fifth differential data signal, and the sixth differential data signal without repetition;

other than the 4 pins transmitting the differential data signals in the second terminal assembly, the one pin of the second terminal assembly transmitting the CC signal and the one pin of the second terminal assembly transmitting the SBU signal, each of remaining 6 pins among the 12 pins of the second terminal assembly is a power pin, a ground pin or a floating pin;

and each differential data signal transmitted by the first terminal assembly is different from each differential data signal transmitted by the second terminal assembly.

2. The USB Type-C male connector of claim 1, wherein:

the first differential data signal and the second differential data signal are a pair of differential data signals D+ and D− defined by a USB specification;

the third differential data signal and the fourth differential data signal are a pair of differential data signals TX+ and TX− defined by the USB specification; and the fifth differential data signal and the sixth differential data signal are a pair of differential data signals RX+ and RX− defined by the USB specification.

3. The USB Type-C male connector of claim 2, wherein:

the two of the 12 pins transmitting the differential data signals in the first terminal assembly are electrically connected to the substrate for transmitting the pair of differential data signals RX+ and RX− defined by the USB specification; and the four of the 12 pins transmitting the differential data signals in the second terminal assembly are electrically connected to the substrate for transmitting the pair of differential data signals TX+ and TX−, and the pair of differential data signals D+ and D− defined by the USB specification.

4. The USB Type-C male connector of claim 2, wherein:

the two of the 12 pins transmitting the differential data signals in the first terminal assembly are electrically connected to the substrate for transmitting the pair of differential data signals TX+ and TX− defined by the USB specification; and the four of the 12 pins transmitting the differential data signals in the second terminal assembly are electrically connected to the substrate for transmitting the pair of differential data signals RX+ and RX−, and the pair of differential data signals D+ and D− defined by the USB specification.

5. The USB Type-C male connector of claim 2, wherein:

the two of the 12 pins transmitting the differential data signals in the first terminal assembly are electrically connected to the substrate for transmitting the pair of differential data signals D+ and D− defined by the USB specification; and the four of the 12 pins transmitting the differential data signals in the second terminal assembly are electrically connected to the substrate for transmitting the pair of differential data signals TX+ and TX−, and the pair of differential data signals RX+ and RX− defined by the USB specification.

6. The USB Type-C male connector of claim 1, wherein:

the first terminal assembly has a surface mount device (SMD) structure; and the second terminal assembly has a dual package in-line (DIP) structure.

7. The USB Type-C male connector of claim 6, wherein:

the rear end of each pin in the first terminal assembly is soldered to the corresponding pad of the substrate using a surface mount technology (SMT); and the rear end of each pin in the second terminal assembly is soldered to the corresponding through-hole pad of the substrate using the SMT.

8. A Universal Serial Bus (USB) Type-C male connector, comprising:

an insulating base body having a first part and a second part;

a first terminal assembly including 12 pins, wherein each pin is provided on the first part of the insulating base body and includes:

a front end exposed on a first contact region in order to be electrically connected to a first signal terminal of a USB Type-C female connector; and a rear end extending outside the first part in order to be soldered to a corresponding pad of a substrate; and a second terminal assembly including 12 pins, wherein each pin is provided on the second part of the insulating base body corresponding to the first part and includes:

a front end exposed on a second contact region of the second part in order to be electrically connected to a second signal terminal of the USB Type-C female connector; and a rear end extending outside the second part and bending towards the substrate in order to be inserted into and soldered to a corresponding through-hole pad of the substrate, wherein:

a number of the 12 pins transmitting differential data signals in the first terminal assembly is equal to 2;

a number of the 12 pins transmitting a sideband use (SBU) signal in the first terminal assembly is equal to 1;

the differential data signals transmitted by the 2 pins in the first terminal assembly are selected from a first differential data signal, a second differential data signal, a third differential data signal, a fourth differential data signal, a fifth differential data signal and a sixth differential data signal without repetition;

other than the two pins transmitting the differential data signals in the first terminal assembly and the one pin transmitting the SBU signal in the first terminal assembly, each of remaining 9 pins among the 12 pins of the first terminal assembly is a power pin, a ground pin or a floating pin;

a number of the 12 pins transmitting the differential data signals in the second terminal assembly is equal to 4;

a number of the 12 pins transmitting a configuration channel (CC) signal in the second terminal assembly is equal to 1;

the differential data signals transmitted by the 4 pins in the second terminal assembly are selected from the first differential data signal, the second data differential signal, the third differential data signal, the fourth differential data signal, the fifth differential data signal, and the sixth differential data signal without repetition;

other than the 4 pins transmitting the differential data signals in the second terminal assembly and the one pin transmitting the CC signal in the second terminal assembly, each of remaining 7 pins among the 12 pins of the second terminal assembly is a power pin, a ground pin or a floating pin; and each differential data signal transmitted by the first terminal assembly is different from each differential data signal transmitted by the second terminal assembly.

9. The USB Type-C male connector of claim 8, wherein:

the first differential data signal and the second differential data signal are a pair of differential data signals D+ and D− defined by a USB specification;

the third differential data signal and the fourth differential data signal are a pair of differential data signals TX+ and TX− defined by the USB specification; and the fifth differential data signal and the sixth differential data signal are a pair of differential data signals RX+ and RX− defined by the USB specification.

10. The USB Type-C male connector of claim 9, wherein:

the two of the 12 pins transmitting the differential data signals in the first terminal assembly are electrically connected to the substrate for transmitting the pair of differential data signals RX+ and RX− defined by the USB specification; and the four of the 12 pins transmitting the differential data signals in the second terminal assembly are electrically connected to the substrate for transmitting the pair of differential data signals TX+ and TX−, and the pair of differential data signals D+ and D− defined by the USB specification.

11. The USB Type-C male connector of claim 9, wherein:

the two of the 12 pins transmitting the differential data signals in the first terminal assembly are electrically connected to the substrate for transmitting the pair of differential data signals TX+ and TX− defined by the USB specification; and the four of the 12 pins transmitting the differential data signals in the second terminal assembly are electrically connected to the substrate for transmitting the pair of differential data signals RX+ and RX−, and the pair of differential data signals D+ and D− defined by the USB specification.

12. The USB Type-C male connector of claim 9, wherein:

the two of the 12 pins transmitting the differential data signals in the first terminal assembly are electrically connected to the substrate for transmitting the pair of differential data signals D+ and D− defined by the USB specification; and the four of the 12 pins transmitting the differential data signals in the second terminal assembly are electrically connected to the substrate for transmitting the pair of differential data signals TX+ and TX−, and the pair of differential data signals RX+ and RX− defined by the USB specification.

13. The USB Type-C male connector of claim 8, wherein:

the first terminal assembly has a surface mount device (SMD) structure; and the second terminal assembly has a dual package in-line (DIP) structure.

14. The USB Type-C male connector of claim 13, wherein:

the rear end of each pin in the first terminal assembly is soldered to the corresponding pad of the substrate using a surface mount technology (SMT); and the rear end of each pin in the second terminal assembly is soldered to the corresponding through-hole pad of the substrate using the SMT.

* * * * *